US008177545B2

(12) United States Patent
Sun et al.

(10) Patent No.: US 8,177,545 B2
(45) Date of Patent: May 15, 2012

(54) METHOD FOR OPERATING A COMBUSTOR HAVING A CATALYST BED

(75) Inventors: Hongqiao Sun, Sugar Land, TX (US); Vesna R. Mirkovic, Pearland, TX (US); Bhaskar Balasubramanian, Houston, TX (US); W. Spencer Wheat, Missouri City, TX (US)

(73) Assignee: Texaco Inc., San Ramon, CA (US)

( * ) Notice: Subject to any disclaimer, the term of this patent is extended or adjusted under 35 U.S.C. 154(b) by 0 days.

(21) Appl. No.: 11/015,408

(22) Filed: Dec. 17, 2004

(65) Prior Publication Data

US 2006/0134568 A1 Jun. 22, 2006

(51) Int. Cl.
*F23C 13/00* (2006.01)
*F23C 13/04* (2006.01)

(52) U.S. Cl. ..... 431/7; 431/170; 431/326; 422/211; 208/113

(58) Field of Classification Search ..... 431/326, 431/170, 7, 268; 208/113; 422/211
See application file for complete search history.

(56) References Cited

U.S. PATENT DOCUMENTS 4,019,316 A 4/1977 Pfefferle
4,054,407 A * 10/1977 Carrubba et al. ..... 431/10
4,154,568 A 5/1979 Kendall et al.
4,189,294 A 2/1980 Rice et al.
4,828,170 A 5/1989 Takman
4,930,454 A * 6/1990 Latty et al. ..... 122/4 D
4,953,512 A * 9/1990 Italiano ..... 122/4 D
5,228,847 A 7/1993 Lywood et al.
5,320,518 A * 6/1994 Stilger et al. ..... 431/7
5,326,253 A * 7/1994 Dalla Betta et al. ..... 431/7
5,460,511 A * 10/1995 Grahn ..... 431/5
5,522,723 A * 6/1996 Durst et al. ..... 431/328
5,622,041 A 4/1997 Feeley et al.
5,635,139 A * 6/1997 Holst et al. ..... 422/108
5,720,609 A 2/1998 Pfefferle
5,901,700 A * 5/1999 Suzuki et al. ..... 431/7
5,989,010 A * 11/1999 Martin et al. ..... 431/7
6,015,540 A * 1/2000 McAdams et al. ..... 423/659
6,039,261 A * 3/2000 Pavese ..... 236/14
6,048,198 A * 4/2000 Okada et al. ..... 431/328
6,136,144 A * 10/2000 Martin et al. ..... 162/14
6,257,868 B1 * 7/2001 Durst et al. ..... 431/7
6,257,869 B1 * 7/2001 Martin et al. ..... 431/7
6,302,683 B1 10/2001 Vestin et al.
7,235,217 B2 * 6/2007 Nguyen ..... 422/198
2004/0029057 A1 * 2/2004 Pettit ..... 431/7
2004/0194384 A1 10/2004 Nguyen

* cited by examiner

*Primary Examiner* — Carl Price
(74) *Attorney, Agent, or Firm* — Frank C. Turner; Melissa Patangia; Christopher D. Northcutt

(57) ABSTRACT

A method for operating a combustor having a catalyst bed. The method includes the steps of directing a flow of air through a catalyst bed, providing heat to the catalyst bed, sensing the temperature in an upstream portion of the catalyst bed to provide an upstream temperature, directing a flow of a fuel through the catalyst bed when the upstream temperature reaches a light-off temperature to produce a combustion reaction, increasing the flow of the fuel until the flow of air and the flow of fuel have a selected air to fuel ratio, and controlling the combustion reaction within the catalyst bed by adjusting the flow of air and the flow of fuel while maintaining the selected air to fuel ratio. The method can include sensing temperatures within the catalyst bed and controlling the combustion reaction in response to the sensed temperatures. The heat provided to the catalyst bed can also be adjusted in response to the sensed temperatures. The methods can further include exchanging heat between heated combustion products and one or more reforming reactants.

6 Claims, 2 Drawing Sheets

METHOD FOR OPERATING A COMBUSTOR HAVING A CATALYST BED

FIELD OF THE INVENTION

The present invention relates generally to the field of catalytic combustion for the purposes of generating heat for use in a chemical process. The methods of the present invention are directed to the start-up and operation of a catalytic combustor that combusts a fuel and an oxygen-containing gas to produce heated combustion products. In some embodiments, the methods are integrated with a fuel processing operation for providing process heat, for preheating the reactants and for eliminating by-products of the operation.

BACKGROUND OF THE INVENTION

Catalytic combustion can be used to provide efficient combustion at relatively low temperatures. The use of a combustion catalyst can achieve near complete combustion of a fuel/air mixture, thus avoiding the emission of high amounts of nitric oxides, carbon monoxide and unreacted fuel(s). Moreover, because the percentage of fuel in the mixture can be quite low, the mixture may not be flammable at atmospheric pressure in the absence of a catalyst. Catalytic combustors can also be relatively compact in size, reliable and quiet in operation.

Catalytic combustors are known for use in various mobile applications. In addition, such combustors can be integrated with gas turbines for partially oxidizing or combusting a fuel to produce a feed stream for combustion in the turbine. Some catalytic combustors are also known for use in fuel processing applications such as those that convert hydrocarbon-based fuels to a hydrogen-rich reformate. By way of example, in a conventional steam reforming process, a hydrocarbon feed such as methane, natural gas, propane, gasoline, naphtha, or diesel, is vaporized, mixed with steam, and passed over a steam reforming catalyst. In such an application, process heat can be provided by a catalytic combustor for vaporizing and preheating the fuel and for steam generation. Process heat can also be used to heat one or more components of the fuel processor to an appropriate reaction temperature and to eliminate by-products produced by the fuel processor and/or a fuel cell stack integrated with the combustor.

Disadvantages of conventional catalytic combustors and the methods associated with them include delays and difficulties that are commonly encountered during start-up, difficulties in achieving complete combustion and difficulties in achieving and maintaining stable combustion temperatures at higher space velocities.

SUMMARY OF THE INVENTION

In an aspect of the present invention, a method for operating a combustor having a catalyst bed is provided. The method includes the steps of directing a flow of air through a catalyst bed and providing heat to the catalyst bed. The temperature in an upstream portion of the catalyst bed is sensed to provide an upstream temperature. A flow of a fuel is directed through the catalyst bed when the upstream temperature reaches a light-off temperature to produce a combustion reaction. The flow of the fuel is increased until the flow of air and the flow of fuel have a selected air to fuel ratio. The combustion reaction is then controlled within the catalyst bed by adjusting the flow of air and the flow of fuel while maintaining the selected air to fuel ratio.

Optionally, the method can include sensing the temperature in a downstream portion of the catalyst bed to provide a downstream temperature or sensing the temperature at an exit of the catalyst bed to provide an exit temperature. The combustion reaction can be controlled in response to the downstream and/or exit temperatures. Moreover, heat provided to the catalyst bed can be adjusted in response to the downstream and/or exit temperatures. The heat provided to the catalyst bed can be reduced when the downstream temperature is at least about the light-off temperature of the fuel. Such a method can further include directing a flow of one or more of a reformate, a purification unit exhaust, and a fuel cell stack exhaust through the catalyst bed. Where a reformate rich in hydrogen is directed through the catalyst bed, the heat provided to the upstream portion of the catalyst bed can be further reduced or discontinued.

The selected air to fuel ratio can enable the complete combustion of the fuel within the catalyst bed. When the fuel comprises methane, the air to fuel ratio can be at least about 60:1 and preferably at least about 70:1. The flow of air and the flow of fuel at the selected air to fuel ratio can have a combined space velocity through the catalyst bed of at least about 16 cm/s. The flow of air and the flow of fuel at the selected air to fuel ratio can have a combined flow rate through the catalyst bed of at least about 160 slpm.

The combustion reaction produces heated combustion products and the methods can optionally include exchanging heat between heated combustion products and one or more reforming reactants.

BRIEF DESCRIPTION OF THE DRAWINGS

The invention may be understood by reference to the following description taken in conjunction with the accompanying drawings.

Figure 1:
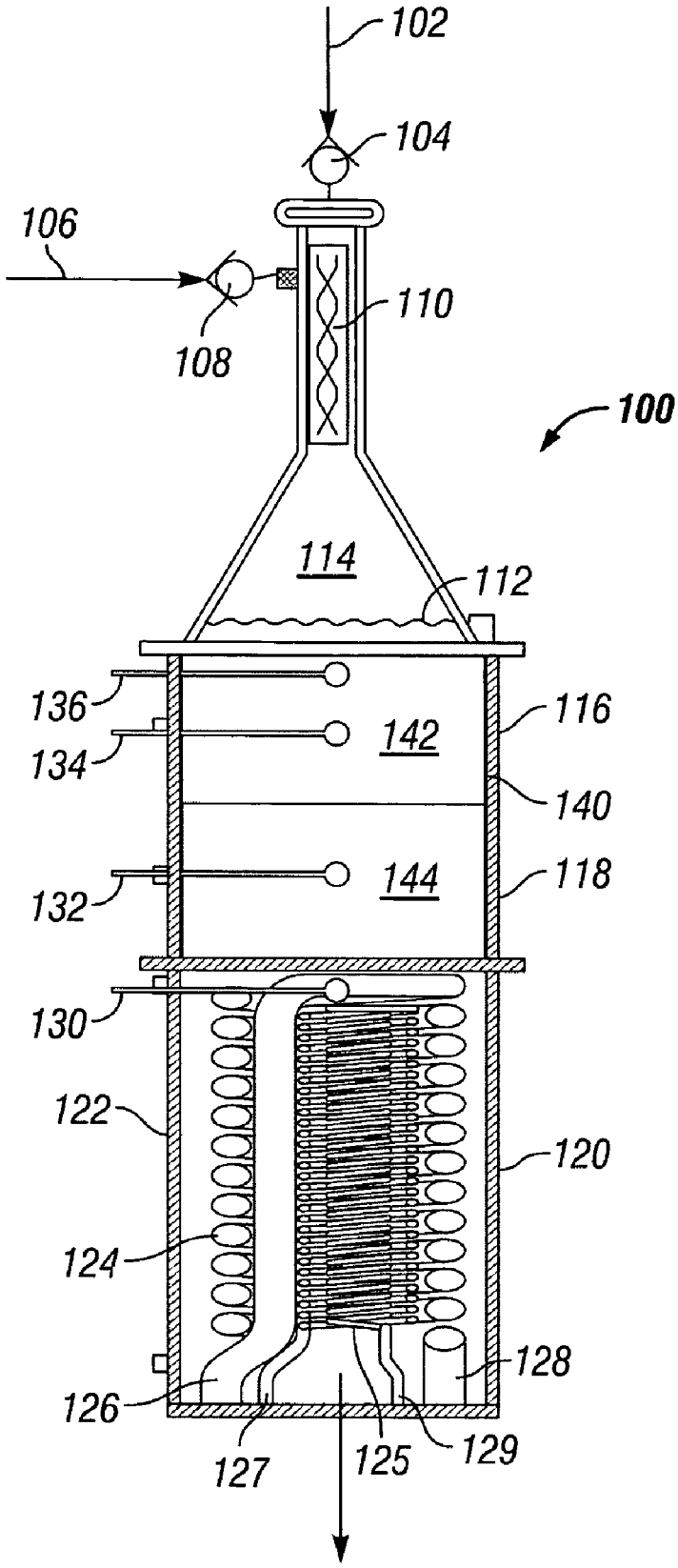
FIG. 1 is a cross sectional view of an apparatus for use in the methods of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Illustrative embodiments of the invention are described below. In the interest of clarity, not all features of an actual embodiment are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The methods of the present invention relate to the combustion of an air/fuel composition in a combustor having a catalyst bed such as are commonly used to generate process heat and to preheat process media for delivery to an associated reactor. In such an embodiment, the combustion temperature is critical for maintaining appropriate preheating temperatures and ensuring the safe operation of the reactor. The combustion reaction and the resulting combustion temperatures can to an extent be controlled by controlling and adjusting the air to fuel ratio of the air/fuel mixture being fed to the catalyst bed. However, it has been found that at flow rates above about 160 slpm and/or above a space velocity of about 16 cm/s, a combustor controlled based solely on the air to fuel ratio can be difficult to light-off and tends to produce variable or fluctuating combustion temperatures. Such problems tend to occur due in part to the inability of the operator or a controller to prevent the combustion reaction from moving through and passing out of the catalyst bed. By holding the air to fuel ratio constant after achieving light-off, and further, by controlling and adjusting the combined flow rate for air and fuel, and/or the combined space velocity for air and fuel, faster light-off and more stable combustion temperatures can be achieved.

A method of the present invention includes directing a flow of air through the catalyst bed. The flow of air is directed through the catalyst bed by pumping air directly from an air source or from an air supply reservoir through a metering device. During start-up, the flow of air to the catalyst bed is initially set and remains fixed during the preheating of the catalyst bed and until the flow rate of fuel is brought up to the selected air to fuel ratio. Once light-off is achieved at the selected air to fuel ratio, the flow of air may be adjusted in response to changes in the flow of fuel in order to maintain the selected air to fuel ratio. For the data shown graphically in FIG. 2 and FIG. 3, the initial flow of air during start-up was set at a rate of at least about 150 slpm, where standard units are 25° C. and 1 atm.

The method includes the step of providing heat to the catalyst bed. Heat is provided to the catalyst bed to bring the bed up to the light-off temperature of the fuel to be combusted. Where the fuel comprises methane, the catalyst bed can be preheated to a temperature of about 320° C. Heat can be provided to the bed by disposing an electrical heating element immediately upstream from the catalyst bed in the path of the flow of air. The air flowing through the catalyst bed is preheated by the heating element and serves to distribute heat throughout the bed. Those skilled in the art will appreciate that other heating means could be used to provide heat to the combustion reactants and the catalyst bed. Moreover, suitable heating means can also include those that are capable of producing variable heat. In some embodiments, the quantity of heat produced by the heating means or the set point of such heating means is adjusted in response to a temperature sensed in the catalyst bed, e.g., a downstream temperature, an exit temperature, etc. By way of example, when the downstream temperature is at least about the light-off temperature of the fuel, the heat provided to the catalyst bed can be reduced to a level that preferably preheats the air/fuel composition for combustion but which does not promote premature combustion of that composition. In a preferred embodiment, the air/fuel composition will be metered at a rate and the heat provided by the heating means will be coordinated so that the combustion reaction extends from the upstream portion of the catalyst bed to the downstream portion. If there is excessive preheating after light-off temperatures have been achieved, the combustion reaction may only occur in the upstream portion of the bed resulting in process inefficiencies.

The temperature in an upstream portion of the catalyst bed is sensed to provide an upstream temperature. The upstream temperature of the catalyst bed should reflect the reaction temperatures that are occurring within the catalyst bed as distinguished from the localized temperatures that may occur at the entrance or upper surface of the catalyst bed adjacent an electrical heating element or other heating means. As illustrated in FIG. 1, the upstream temperature is provided by thermocouple 134 rather than thermocouple 136, which is intended to sense the local temperature near the upper surface of the catalyst bed. Temperatures within the catalyst bed can be sensed using thermometers, thermocouples or any other heat sensing device that is capable of sensing the reaction temperatures within the catalyst bed without interfering with the reaction and without being degraded by the process conditions.

A flow of a fuel is directed through the catalyst bed when the upstream temperature is at least about the light-off temperature of the fuel so that the combustion reaction is produced. Fuel is pumped from a fuel source through a metering device to the catalyst bed. The light-off temperature will primarily depend on the composition of the fuel and the activity of the catalyst in the bed for that fuel. In the case of an air/fuel composition where natural gas comprising mostly methane is the fuel, the light-off temperature should be at least about 300° C. During start-up, the catalyst bed is heated by the electrical heating element immediately upstream from the bed and by the flow of heated air through the bed. Where the catalyst bed has an extended length having both upstream and downstream portions, the upstream portion of the bed will reach light-off temperature before the downstream portion. Thus, when the upstream temperature reaches the light-off temperature, a flow of fuel can be directed to the catalyst bed to produce a combustion reaction. By initiating the combustion reaction as soon as a light-off temperature is reached in an upstream portion of the bed, the downstream portions of the bed can be more quickly heated to a light-off temperature. The flow of the fuel to the catalyst bed is increased until the flow of air and the flow of fuel have a selected air to fuel ratio. The flow of fuel can be increased gradually over a selected period of time or based on some sensor feedback such as a sensed temperature within the catalyst bed. In some embodiments, the flow of fuel is increased gradually as a function of time, e.g., ramping up the flow of fuel from 0 to 2 slpm over a ten minute period.

The air to fuel ratio is selected so that the fuel can be completely combusted within the catalyst bed given the composition of the fuel, the activity of the catalyst for that fuel and the anticipated flow rate of the air/fuel composition. Where the fuel composition comprises methane, the selected air to fuel ratio is at least about 60:1, preferably at least about 70:1, and more preferably at least about 75:1. At the selected air to fuel ratio, the flow of air and the flow of fuel will have a combined flow rate of at least about 160 slpm, preferably at least about 200 slpm, and more preferably at least about 220 slpm. Similarly, at the selected air to fuel ratio, the flow of air and the flow of fuel will have a combined space velocity through the catalyst bed of at least about 16 cm/s, preferably at least about 20 cm/s, and more preferably at least about 22 cm/s. The upper limits of the combined flow rate and combined space velocity for the air/fuel composition will depend in part on the length of the catalyst bed. By maintaining the selected air to fuel ratio, the combustion reaction is controlled or held within the catalyst bed by adjusting the flow of air and the flow of fuel. In this manner, the combustion reaction is held and completed within the catalyst bed rather than allowing the reaction to move beyond the downstream end or exit of the bed. If combustion occurs downstream of the catalyst bed, the reaction is more likely to be incomplete and the reaction temperatures more variable.

Optionally, the method can include sensing the temperature in a downstream portion of the catalyst bed to provide a downstream temperature. Similarly, the method could optionally include sensing the temperature at an exit of the catalyst bed to provide an exit temperature. As described above, the combustion reaction can be controlled by adjusting the flow of air and the flow of fuel in response to the catalyst bed's downstream temperature and/or exit temperature. Moreover, the heat provided to the catalyst bed to preheat the bed and the air/fuel composition can be adjusted in response to the catalyst bed's downstream temperature and/or exit temperature. Specifically, the preheat from the heating element is coordinated with the air and fuel flow rates so that at least a portion of the combustion reaction is sustained in the downstream portion of the catalyst bed. If the set point of the heating element is set too high, premature combustion can occur resulting in the combustion reaction occurring only in the upstream portion of the catalyst bed.

After achieving light-off temperatures in a downstream portion of the catalyst bed, the method can also include directing a flow of one or more of a reformate, a purification unit exhaust, and a fuel cell stack exhaust through the catalyst bed. Where a reformate rich in hydrogen is directed through the catalyst bed, the heat provided to preheat the catalyst bed and the air/fuel composition can be further reduced or discontinued. The amount of heat provided to the bed in this instance will depend on the composition of the air/fuel composition and the flame speed of that composition in the catalyst bed. In addition, the flow rate and space velocity are affected when the air/fuel composition is altered by incorporating a reformate, a purification unit exhaust and/or a fuel cell stack exhaust. For example, where a reformate rich in hydrogen is combusted with the air and fuel, the combustion flame speed for this hydrogen rich air/fuel composition is increased enabling the use of higher flow rates and space velocities without causing the combustion reaction to shift out of the downstream end of the catalyst bed. Moreover, the combustion of a hydrogen-rich air/fuel composition tends to produce more uniform combustion temperatures.

The combustion reaction produces heated combustion products and the methods can optionally include exchanging heat between heated combustion products and one or more reforming reactants.

The methods of the present invention are carried out in a combustor having a catalyst bed. The specific features of the combustor apparatus are not believed to be critical to the methods although combustors having a catalyst bed that is extended in length tend to experience the problems addressed herein. The following description of a catalytic combustor is derived from U.S. Ser. No. 10/408,080, "Method And Apparatus For Rapid Heating Of Fuel Reforming Reactants" filed Apr. 3, 2003 by Nguyen.

A combustor that is used for generating process heat and preheating reactants for a downstream reactor typically includes a combustion section that houses a catalyst bed and a heat exchange section that houses one or more heat exchanging elements. For purposes of manufacture, cost and simplicity of design, it is preferable that the two sections be arranged in series and oriented about a common axis. Further, it is believed that a more rapid and uniform heating of the heat exchange section will occur when the combustor is operated in a vertical orientation with the combustion section disposed upstream above the heat exchange section.

The dimensions of the combustor apparatus can impact the speed at which start-up can be achieved. The housing of the combustor can be formed by a cylindrical wall having a length and an internal diameter in a ratio from about 7:1 to about 3:1, and preferably from about 6:1 to about 4:1. Specifically, it is preferred that the housing have a length of at least about 20 inches, preferably at least about 30 inches, and more preferably at least about 40 inches. The internal diameter of the housing is less than about 10 inches, preferably less than about 8 inches, and more preferably less than about 6 inches.

Upstream of the catalyst bed are one or more inlets through which an oxygen-containing gas and a hydrocarbon fuel are directed. The oxygen can be in the form of air, enriched air, or substantially pure oxygen. The hydrocarbon fuel is preferably in the gas phase at ambient conditions, but may be liquid provided that it can be easily vaporized. As used herein, the term "hydrocarbon" includes organic compounds having C—H bonds which are capable of producing hydrogen from a partial oxidation, steam reforming and/or autothermal reactions. The presence of atoms other than carbon and hydrogen in the molecular structure of the compound is not excluded. Thus, suitable fuels for use in the method include but are not limited to such fuels as natural gas, methane, ethane, propane, butane, naphtha, gasoline, diesel, alcohols such as methanol, ethanol, propanol and the like, and mixtures of the above. A preferred hydrocarbon fuel comprises natural gas. Where one or more of a reformate, a purification unit exhaust or a fuel cell stack exhaust are to be combusted with the air/fuel composition, such materials can be combined with the fuel and/or air and enter the combustion section through a common inlet. In an alternative, such materials can have a dedicated inlet to the combustion section of the apparatus.

A static mixer is disposed upstream from catalyst bed for mixing air and fuel prior to entry into the catalyst bed. Alternate mixing means can be provided as a separate module external to the combustor apparatus. In addition, the combustor has means for preheating the catalyst bed and the flows of air and fuel. An electrical heating element can be provided upstream from the catalyst bed that is capable of reaching temperatures of at least about 300° C. One skilled in the art will appreciate that different preheating means can be substituted for an electrical heating element.

Disposed within the combustion section is the catalyst bed. The catalyst bed comprises an oxidation catalyst that has activity for the selected hydrocarbon fuel. Examples of suitable oxidation catalysts include noble metals such as platinum, palladium, rhodium, and/or ruthenium on an alumina wash coat on a monolith, extrudate, pellet or other support. Non-noble metals such as nickel or cobalt have also been used. Other wash coats such as titania, zirconia, silica, and magnesia have also been cited in the literature. Many additional materials such as lanthanum, cerium, and potassium have been cited in the literature as "promoters" that improve the performance of the oxidation catalyst. In an embodiment where the hydrocarbon fuel is natural gas, a suitable catalyst will include a palladium oxide dispersed on a support material comprising a relatively inert refractory inorganic oxide such as alumina, which is optionally impregnated with stabilizers, promoters or other additives.

The combustion reaction occurs very quickly to the complete conversion of oxygen and fuel and produces heat. It is intended that regardless of the composition of the catalyst, the catalyst medium should provide a non-diffused flow path through which the heated combustion products can flow. Specifically, the catalyst medium should enable a gas to flow therethrough in the range of at least about 5,000 gas hourly space velocity (GSHV) up to about 20,000 GHSV. The temperature of the combustion gases passing through the catalyst medium will be between about 40° C. and about 650° C. and the pressure should be approximately ambient. Preferably, the catalyst medium is a monolith support having a honeycomb-type structure that provides a plurality of channels through which the heated combustion products can flow. The data presented in FIG. 2 and FIG. 3 were obtained using a catalyst bed comprising a pair of wash coated monolith blocks that were stacked within the combustion section one above the other. These catalyst blocks were purchased from Engelhard Corp. of Iselin, N.J., under the trade name SELECTRA™.

Heated combustion products flow from the catalyst bed into the heat exchange section. Disposed within the heat exchange section in the path of the heated combustion products is at least one heat exchanging element such as a heat exchange coil. Fuel processing reactants that require preheat prior their reaction are directed through one or more of such coils. The fuel processing reactant may be a hydrocarbon fuel, an oxygen-containing gas, water, or some combination thereof. Similarly, where one or more components of the fuel processor apparatus is to be preheated with heat generated in the combustor, a heat exchange fluid may be heated in the heat exchange section for transfer to the intended fuel processing component.

The methods of the present invention can optionally be carried out utilizing a controller to monitor and control the operation of the catalytic combustor and optional fuel processor and/or fuel cell system. In some embodiments, the controller is implemented on a single computing system for controlling each facet of the operation of the apparatus that is not under manual control. In other embodiments, the system controller can comprise multiple computing systems, each for controlling some designated facet of the operation of the apparatus. The system controller can be rack-mounted or implemented as a desktop personal computer, a workstation, a notebook or laptop computer, an embedded processor, or the like. Indeed, this aspect of any given implementation is not material to the practice of the invention.

The computing system preferably includes a processor communicating with memory storage over a bus system. The memory storage can include a hard disk and/or random access memory ("RAM") and/or removable storage such as a floppy magnetic disk and/or an optical disk. The memory storage is encoded with a data structure for storing acquired data, an operating system, user interface software, and an application. The user interface software, in conjunction with a display, implements a user interface. The user interface can include peripheral I/O devices such as a key pad or keyboard, mouse, or joystick. The processor runs under the control of the operating system, which may be practically any operating system known to the art. The application is invoked by the operating system upon power up, reset, or both, depending on the implementation of the operating system.

Software implemented aspects of the invention are typically encoded on some form of program storage medium or implemented over some type of transmission medium. The transmission medium may be twisted wire pairs, coaxial cable, optical fiber, or some other suitable transmission medium known to the art. Some portions of the detailed descriptions herein are presented in terms of a software implemented process involving symbolic representations of operations on data bits within a memory in a computing system. These descriptions and representations are the means used by those in the art to most effectively convey the substance of their work to others skilled in the art. The process and operation require physical manipulations of physical quantities. Usually, though not necessarily, these quantities take the form of electrical, magnetic, or optical signals capable of being stored, transferred, combined, compared, and otherwise manipulated. It has proven convenient at times, principally for reasons of common usage, to refer to these signals as bits, values, data, elements, symbols, instructions, characters, terms, numbers, or the like. It should be borne in mind, however, that all of these and similar terms are to be associated with the appropriate physical quantities and are merely convenient labels applied to these quantities. Furthermore, the actions and processes of an electronic device that manipulates and transforms data represented as physical (electronic, magnetic, or optical) quantities within some electronic device's storage into other data similarly represented as physical quantities have been denoted by terms such as "processing," "computing," "calculating," "comparing," "determining," "displaying," and the like.

DETAILED DESCRIPTION OF THE FIGURES

The methods of the present invention are carried out in a combustion apparatus having a catalyst bed. As illustrated in FIG. 1, the apparatus 100 can include elongated body 122 that is cylindrical in cross section and comprises catalyst bed 140 and heat exchange section 120.

Fuel and air for combustion enter the top portion of the apparatus through lines 106 and 104, respectively. Metering devices such as metering valves 108 and 104 can be used to control the flow of fuel and air into the apparatus. Where a reformate from a fuel processor or some other hydrogen-containing gas is to be combusted with the fuel, the gas can be delivered to the apparatus through fuel line 106 or through a separate line (not shown). Upon entering the apparatus, the fuel and air are mixed in static mixer 110 before flowing into preheat zone 114. Preheat zone 114 and the fluids flowing through it can be heated by electrical heating element 112. Preheat zone 114 is disposed immediately upstream from catalyst bed 140 and is in fluid communication with the catalyst bed.

Catalyst bed 140 comprises catalyst disposed on a pair of monolith block supports 142 and 144 arranged in series. The catalyst bed has upstream portion 116 and downstream portion 118. As illustrated, thermocouples 132, 134 and 136 are used to sense temperatures at various locations within the catalyst bed. Thermocouple 136 senses the temperature near the upper surface of the catalyst bed, thermocouple 134 senses the reaction temperature in the upstream portion 116 and thermocouple 132 senses the reaction temperature in downstream portion 118.

Heat exchange section 120 is in fluid communication with catalyst bed 140 for receiving heated combustion products flowing out of the catalyst bed. Heat exchange coils 124 and 125 are disposed in the heat exchange section in the flow path of the heated combustion products. Coil 124 has inlet 126 in communication with sources of fuel and/or air (not shown) and outlet 128 in communication with a fuel processing reactor (not shown) for preheating and delivering the preheated fuel and/or air to the reactor at a desired temperature. Similarly, coil 125 has inlet 127 in communication with a source of water (not shown) and outlet 129 in communication with a fuel processing reactor for converting the water to steam and delivering the steam to the reactor at a desired temperature. The heated combustion products enter heat exchange section 120 and flow down around coils 124 and 125 exchanging heat with the fluids flowing through the coils. The heat-depleted combustion products then flow out of the apparatus through one or more openings in the lower portion of the heat exchange section to a vent (not shown).

Figure 2:
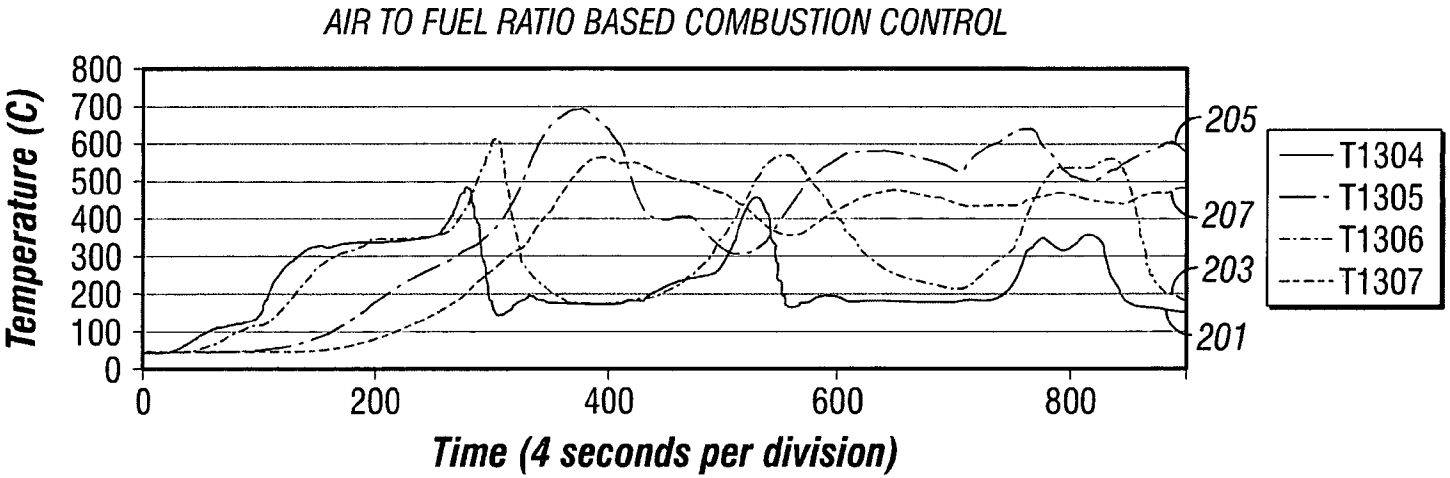
FIG. 2 is a graph illustrating temperature data acquired when operating a catalytic combustor using conventional methods.

FIG. 2 is a graph illustrating actual temperature data acquired from combusting natural gas and air in a catalytic combustor such as that illustrated in FIG. 1. The data was acquired using a conventional method of operation wherein the combustion reaction was controlled by making adjustments to the air to fuel ratio. In FIG. 2, line 201 represents temperatures sensed by a thermocouple near the entrance of the catalyst bed, e.g., thermocouple 136 of FIG. 1. Line 203 represents temperatures sensed by a thermocouple in an upstream portion of the catalyst bed, e.g., thermocouple 134. Line 205 represents temperatures sensed by a thermocouple in a downstream portion of the catalyst bed, e.g., thermocouple 132. Line 207 represents temperatures sensed by a thermocouple near the exit of the catalyst bed, e.g., thermocouple 130. The instability of the combustion reaction is evident from the temperatures shown. Further, delays in reaching an operational state were also incurred as the light-off procedure had to be repeated twice in order to achieve a sustained combustion reaction in the downstream portion of the catalyst bed. In addition, the exit temperatures of the heated combustion products flowing into the heat exchange section of the device exhibited significant fluctuations. Because of such fluctuations, the heated combustion products may not provide a reliable source of process heat depending on the process heat requirements of the associated reactor.

Figure 3:
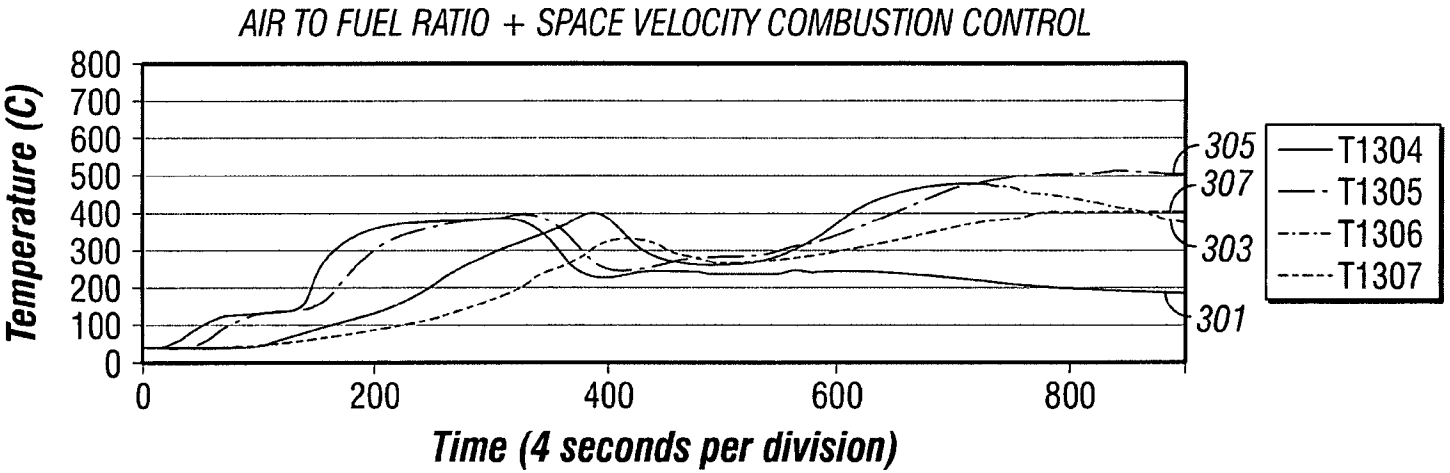
FIG. 3 is a graph illustrating temperature data acquired when operating a catalytic combustor using a method of the present invention.

Temperature data acquired from combusting natural gas and air in a combustor such as described herein are shown in the graph of FIG. 3. In this instance, the air to fuel ratio was held constant after achieving light-off and the combustion reaction was controlled by adjusting the combined space velocity of the air and fuel. A detailed description of the start-up procedure used is provided below. In FIG. 3, line 301 represents temperatures sensed by a thermocouple near the entrance of the catalyst bed, e.g., thermocouple 136 of FIG. 1. Line 303 represents temperatures sensed by a thermocouple in an upstream portion of the catalyst bed, e.g., thermocouple 134. Line 305 represents temperatures sensed by a thermocouple in a downstream portion of the catalyst bed, e.g., thermocouple 132. Line 307 represents temperatures sensed by a thermocouple near the exit of the catalyst bed, e.g., thermocouple 130. In contrast to the start-up illustrated in FIG. 2, the results shown in FIG. 3 indicate that the combustion reaction was sustained in the downstream portion of the catalyst bed without having to repeat the light-off procedure. Moreover, it is clear that the combustion reaction extended between the upstream and downstream portions of the bed. In addition, the exit temperatures of the heated combustion products that flowed from the catalyst bed to the heat exchange section, as represented by line 307, were more stable and uniform.

Experimental

The results presented in FIG. 3 were acquired using a combustor such as that illustrated in FIG. 1 and described in detail above. The catalyst section had a length of about 12 inches and the heat exchanger section had a length of about 17 inches. The internal diameter of the combustor was about 5 inches. The catalyst bed consisted of a pair of monolith blocks purchased from Englehard Corp. under the trade name SELECTRA™. The fuel was natural gas.

During start-up, air was initially fed through the catalyst bed at a rate of about 150 slpm. The electrical heating element 112 was energized to raise the temperature of the upstream portion of the catalyst bed and to preheat the flow of air. The initial set point for electrical heating element was 350° C. When the temperature sensed by thermocouple 134 in upstream portion 116 reached the light-off temperature for the fuel, 320° C., a flow of natural gas was initiated through the bed. The flow of natural gas was gradually increased at a rate of about 1 liter every five minutes until the selected air to fuel ratio was achieved. When the selected air to fuel ratio was achieved, the flow of natural gas was 2 slpm. Holding the air to fuel ratio constant, the flow of natural gas through the catalyst bed was gradually increased to 3 slpm over a period of about five minutes. This resulted in an increase in the combined flow rate of air and fuel from about 160 slpm to about 240 slpm. These changes also represented an increase in the combined space velocity of air and fuel through the catalyst bed from about 16 cm/s to about 24 cm/s. When the downstream temperature reached the light-off temperature of the fuel, the power to the heating element was reduced from the initial set point of 350° C. to about 200° C. At this set point, the heating element provided sufficient heat to preheat the combustion fuel and air, but did not cause pre-mature combustion of the air/fuel mixture. The combustion reaction extended from the upstream portion of the bed to the downstream portion but did not shift out of the catalyst bed.

What is claimed is:

1. A method for operating a combustor associated with a downstream fuel processing reactor, the method comprising the steps of:

providing a combustor associated with a downstream fuel processing reactor wherein the combustor comprises a catalyst bed in fluid communication with a heat exchange section;

directing a flow of air through the catalyst bed;

providing heat to the catalyst bed;

sensing temperature in an upstream portion of the catalyst bed to provide an upstream temperature;

directing a flow of a fuel through the catalyst bed to produce a combustion reaction when the upstream temperature is at least about a light-off temperature of the fuel;

increasing the flow of the fuel until the flow of air and the flow of fuel have a selected air to fuel ratio;

controlling the combustion reaction within the catalyst bed by adjusting the flow of air and the flow of fuel while maintaining the selected air to fuel ratio;

controlling the combustion reaction within the catalyst bed by adjusting a combined space velocity for air and fuel through the catalyst bed; and sending heated combustion products to the heat exchange section for preheating of fuel processing reactants and for converting water to steam for the fuel processing reactor.

2. The method of claim 1, further comprising sensing temperature in a downstream portion of the catalyst bed to provide a downstream temperature.

3. The method of claim 2, wherein in the step of providing heat to the catalyst bed, the heat is adjusted in response to the downstream temperature.

4. The method of claim 3, wherein in the step of providing heat to the catalyst bed, the heat is adjusted when the downstream temperature is at least about the light-off temperature of the fuel.

5. The method of claim 4, further comprising directing a flow of one or more of a reformate, a purification unit exhaust, and a fuel cell exhaust through the catalyst bed.

6. The method of claim 5, wherein a flow of a reformate rich in hydrogen is directed through the catalyst bed and in the step of providing heat to the catalyst bed, the heat is discontinued.

* * * * *